US006213964B1

(12) United States Patent
Pesovic et al.

(10) Patent No.: US 6,213,964 B1
(45) **Date of Patent: *Apr. 10, 2001**

(54) HYDROMECHANICAL MASSAGING APPARATUS WITH DETACHABLE HYDRAULICS

(76) Inventors: Vojin Pesovic, P.O. Box 235364, Honolulu, HI (US) 96823; Predrag P. Pesovic, Danteova 50, Belgrade (YU), 11060

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/647,814

(22) Filed: May 15, 1996

(51) Int. Cl.[7] ..... A61H 9/00

(52) U.S. Cl. ..... 601/160; 601/155; 601/125; 601/123; 601/122

(58) Field of Search ..... 601/122, 123, 601/125, 154, 155, 160, 169

(56) References Cited

U.S. PATENT DOCUMENTS

| | | | | |
|---|---|---|---|---|
| 927,125 | * | 7/1909 | Davis | 601/125 |
| 950,059 | * | 2/1910 | Sickels | 601/160 |
| 1,948,167 | * | 2/1934 | Cornwell | 601/155 |
| 3,077,878 | * | 2/1963 | Baulard-Cogan | 601/130 |
| 3,528,411 | | 9/1970 | Clements . | |
| 3,530,852 | | 9/1970 | Fattor . | |
| 3,736,924 | | 6/1973 | Jacuzzi et al. . | |
| 3,970,078 | * | 7/1976 | Rogers, Jr. | 601/125 |
| 4,139,001 | | 2/1979 | Macabee . | |
| 4,141,502 | | 2/1979 | Grohe . | |
| 4,239,409 | | 12/1980 | Osrow . | |
| 4,270,526 | * | 6/1981 | Morales et al. | 601/154 |
| 4,378,007 | | 3/1983 | Kachadourian . | |
| 4,427,001 | * | 1/1984 | Kiefer et al. | 601/125 |
| 4,432,355 | | 2/1984 | Delluc . | |
| 4,441,488 | | 4/1984 | Macabee . | |
| 4,458,676 | * | 7/1984 | Pileggi | 601/125 |
| 4,933,999 | | 6/1990 | Mikiya et al. . | |

FOREIGN PATENT DOCUMENTS

| | | | | |
|---|---|---|---|---|
| 66895 | * | 2/1893 | (DE) | 601/122 |
| 472697 | * | 11/1930 | (DE) | 601/125 |
| 2238563 | | 9/1973 | (DE) . | |
| 296 03 435 | | 5/1996 | (DE) . | |
| 0 092 449 | | 10/1983 | (EP) . | |
| 668225 | | 11/1929 | (FR) . | |
| 1270620 | | 1/1962 | (FR) . | |
| 1335549 | * | 7/1963 | (FR) | 601/123 |
| 2480118 | | 10/1981 | (FR) . | |

(List continued on next page.)

*Primary Examiner*—Mickey Yu
*Assistant Examiner*—Benjamin Koo
(74) *Attorney, Agent, or Firm*—Jacobson, Price, Holman & Stern, PLLC

(57) ABSTRACT

A hydromechanical massaging apparatus has a mechanical component providing mechanical massaging and a hydraulic component providing hydraulic massaging. The mechanical component has a longitudinal body, with a handle on its upper surface. A rear roller is centrally mounted on the rear end of the body, and a front axle carrying a pair of front rollers is mounted on the front end of the body. Each of the front rollers is attached to an end of the front axle for limited universal movement by a ball joint connection. Each joint has a sphere captured within semi-spherical shells. The hydraulic component includes a transverse cylindrical spray chamber having a series of nozzles. The cylindrical spray chamber is removably supported in the middle of the body by a correspondingly shaped cylindrical seat. The chamber is held in place by tooth-like members. A series of water jets are emitted from the nozzles between the front and rear rollers of the mechanical portion. A turbine is preferably mounted within the cylindrical spray chamber so that incoming water strikes the turbine blades, which alternately close and open the nozzles to provide pulsating water jets.

37 Claims, 5 Drawing Sheets

FOREIGN PATENT DOCUMENTS

| | | |
|---|---|---|
| 2501503 | 9/1982 | (FR) . |
| 2596983 | 10/1987 | (FR) . |
| 2598726 | 11/1987 | (FR) . |
| 1534013 | 11/1978 | (GB) . |
| 2 288 121 | 10/1995 | (GB) . |
| 92 18250 | 10/1992 | (WO) . |

* cited by examiner

HYDROMECHANICAL MASSAGING APPARATUS WITH DETACHABLE HYDRAULICS

BACKGROUND OF INVENTION

1. Field of the Invention

The present invention relates to body massaging devices. More specifically, the present invention relates to a hydromechanical massaging device which combines a hydraulic massager component and a mechanical massager component that are detachable one from the other.

2. Description of the Related Art

Many massaging devices, for home or physiotherapeutic use, are well known in the art. These devices could be roughly classified in one of three groups: mechanical, hydraulic, and the combination of mechanical and hydraulic, or hydromechanical.

Mechanical massaging devices effect massage by the use of mechanical elements coming into contact with the body. Mechanical massagers are disclosed, for instance, in U.S. Pat. No. 4,378,007, French Patents Nos. 2 480 118, 2 596 983, 2 598 726, and Great Britain Patent Specification No. 1 534 013. Generally, mechanical massaging devices have wheels, rollers or spheres, the outer circumferential surface of which is provided with a wide variety of relief shapes and protrusions. Mechanical massagers effect stimulation of the body part by mechanical "rolling" against the part of the body to be massaged. Specifically, the massager is pressed against the body and maneuvered or rolled over the portion of the body to be massaged. The shape and location of the protrusions on the outer surface of the device function to stimulate the skin and muscles of the body, thereby serving to relieve tension. A vibratory component may also be provided to further stimulate the body.

Hydraulic massaging devices in the prior art use water as the working medium to stimulate the body. Prior art hydraulic massagers are disclosed, for instance, in U.S. Pat. Nos. 3,530,852, 3,528,411 and 4,441,488. Hydraulic massagers generally have more intricate structure and components than do mechanical massagers and incorporate pulsating jet streams. Hydraulic massagers are essentially shower head devices that attach directly to a shower hose, usually by screwing the massager directly to a nut on the end of the hose.

Hydromechanical massaging devices are a combination of both the mechanical/vibrating massagers and the hydraulic massagers. Hydromechanical devices are disclosed, for instance, in U.S. Pat. Nos. 4,239,409 and 4,139,001, German Patent No. 2 238 563 and French Patent No. 2 501 503. These prior art hydromechanical massaging devices are generally constructed as shower attachments having massaging components, such as a brush or fingers. Heretofore, however, these devices have failed to combine a solid massaging surface providing a rolling action over the body with a hydraulic massaging component centrally located with respect to the mechanical component or components so that the body part being massaged is treated to the mechanical rolling action and the hydraulic action simultaneously. Further, in the prior art hydromechanical devices, the mechanical element of the massaging device is inseparable from the hydraulic element of the massaging device. Consequently, the user cannot independently use either the hydraulic element or the mechanical element without the other being present. In addition, the entire hydromechanical massager must be replaced when either the mechanical portion or the hydraulic portion needs replacing.

SUMMARY OF THE INVENTION

In contrast, the present invention is a hand-held hydromechanical massaging device which has two integrated components formed primarily from molded plastic that are detachable from one another. The first component is a hydraulic component that effects massage with water. The hydraulic component can be hooked up with an existing home water supply, such as a shower hose or the like. The hydraulic component has an arm which carries the water to a spray chamber in the form of a transverse cylinder having a series of openings forming spray nozzles. In the preferred embodiments, a turbine having a rotor and blades is mounted within the cylinder to provide a pulsating water stream. The incoming water strikes the rotor, causing the turbine and blades to alternately close and open the nozzle openings, thus providing the pulsating water jets.

The second component of the massager of the present invention is a mechanical component that is used for rolling mechanical massaging. The mechanical portion includes a plastic body having a pair of front rollers on a common front axle, a centrally mounted rear roller, and a handle at the front end of the body extending outwardly and backwardly. Each front roller is preferably mounted on the ends of the front axle by a universal joint connection, such as a ball joint. The ball joint fastened to the ends of the front axle movably supports corresponding semi-spherical shells positioned on the inside of each front roller. The arrangement of the front and rear rollers provides for easy movement of the massager over the curved parts of the body.

A plurality of rounded protrusions or knobs, preferably in the shape of truncated or semi-spherical studs, are located on annular elements mounted about the circumference of each of the rollers. Preferably, the annular elements are interchangeable and can have any desired surface configuration and body feel. For instance, the annular elements may have surfaces which are coarse or fine, hard or soft, or in the form of a brush or the like, depending on the feel to be imparted to the body being massaged.

The hydraulic component removably attaches to the mechanical component at a position preferably between the front and rear rollers in the middle of the massager body. As such, the hydraulic component emits its pulsating water jets between the front and rear rollers to hydraulically massage the body. At the same time, the rollers are mechanically pressed against the skin and the subcutaneous tissue to provide mechanical massaging of the body simultaneously to the same body part receiving the hydraulic action. It is believed that the positioning of the hydraulic pulsating water jets longitudinally between the front and rear massaging rollers permits the user to focus pulsating warm water jets between mechanical rollers and thereby enhance the hydraulic and mechanical massaging action of the combined components.

The hydraulic component is fastened to the mechanical component preferably by tooth-like members provided on the body of the massager. The handle extends over the attached hydraulic component and is used to control the movement of the massager. The massager is easy to handle, well-shaped and capable of stimulating circulation, removing toxins, breaking-up layers of fat, relieving stress and the like.

Accordingly, it is an object of the present invention to provide a massager having both a mechanical component and a hydraulic component which together function to massage the body part with a rolling mechanical massaging action and a hydraulic massaging action.

It is another object of the present invention to provide a hydromechanical massaging device in which the hydraulic massaging action is centrally located between two mechanical massaging components so that the body part being massaged feels simultaneous mechanical and hydraulic massaging action.

It is a further object of the present invention to provide a hydromechanical massaging device in which the mechanical massaging action is provided by rolling surfaces that can be easily pressed against the body and rolled over the portion of the body to be massaged, while at the same time providing hydraulic massaging action to the same body part.

It is yet another object of the present invention to provide a hydromechanical massager having a hydraulic component that is easily separable from the mechanical component for separate use or replacement.

A still further object of the present invention is to provide a hydromechanical massaging device capable of operating effectively in any position even when the device is held in a vertical position or upside down.

A yet still further object of the present invention is to provide a structure in which different mechanical massaging elements can be readily interchanged thus allowing the massager to impart different mechanical feels to the body being massaged.

Yet another object of the present invention is to provide a hydromechanical massaging device in which the rolling mechanical components can be tilted to provide a close rolling action to the body surface being massaged.

A final object of this invention to be specifically enumerated herein is to provide a hydromechanical massaging apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
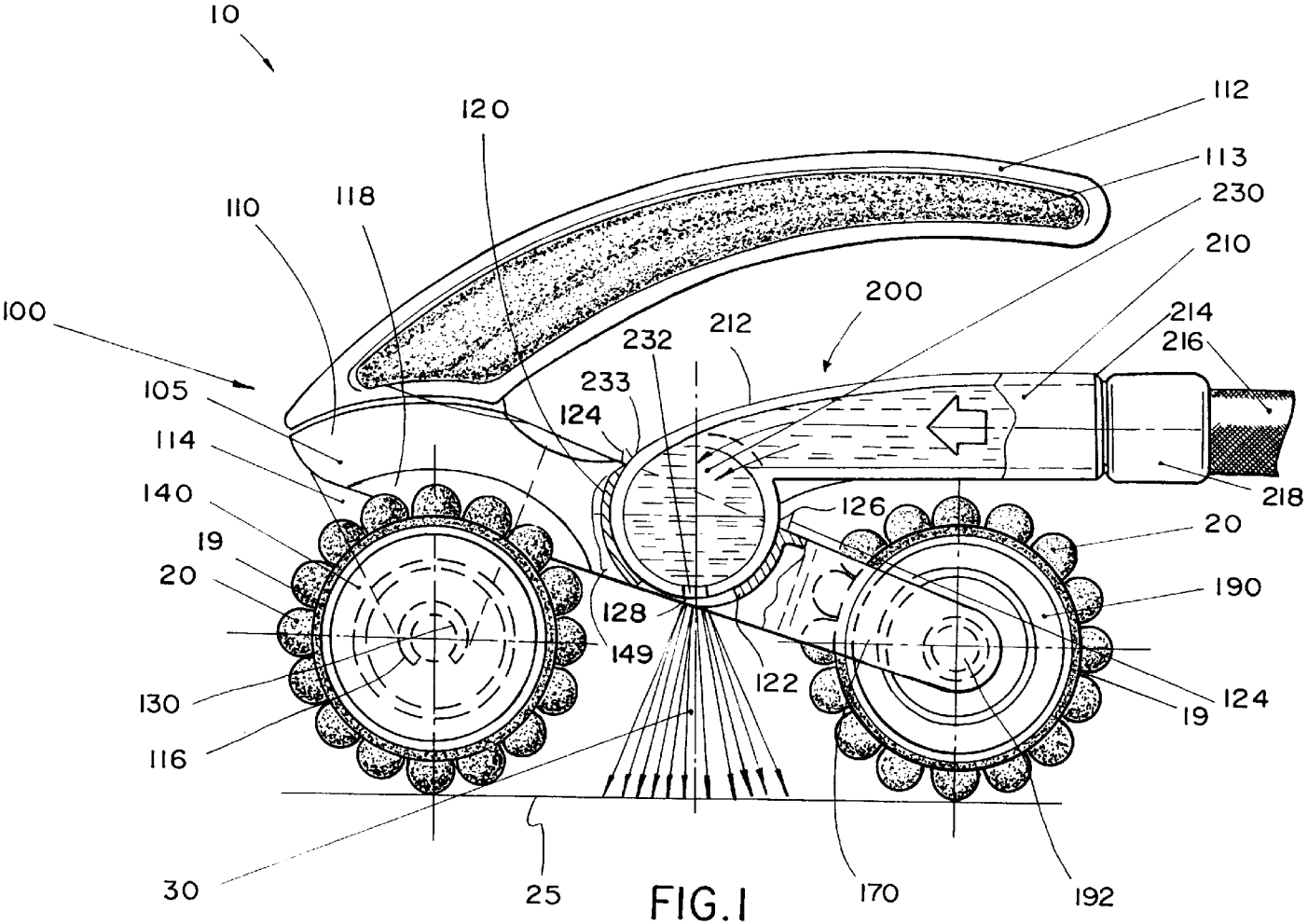
FIG. 1 is a side view, partly sectioned, of one massaging apparatus made in accordance with the present invention.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Now referring to the drawings, FIG. 1 shows the hydromechanical massaging apparatus 10 of the present invention. The massager 10 has two basic components: a mechanical component 100 and a hydraulic component 200. The mechanical component 100 essentially includes body 105, handle 112, front rollers 140, rear roller 190, and a horizontally extending receiving seat or nest 120. The body 105 has a longitudinal front end 110, rear end 170, and a middle section 149. Body 105 is preferably molded of rigid plastic in a one piece construction. Especially preferred plastics for the various rigid components of the present invention are acrylonitrile butadiene styrene (ABS) and polyester. However, if desired, the body can be formed in two or more pieces which are attached together as by gluing, plastic bolts, or the like.

Figure 2:
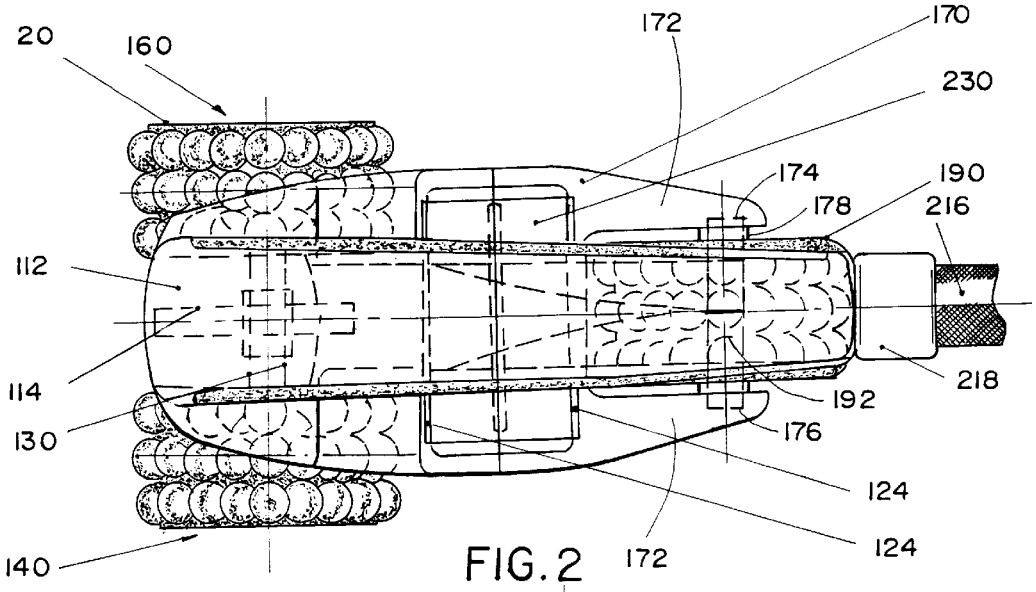
FIG. 2 is a top view of the massaging apparatus shown in FIG. 1.
Figure 3:
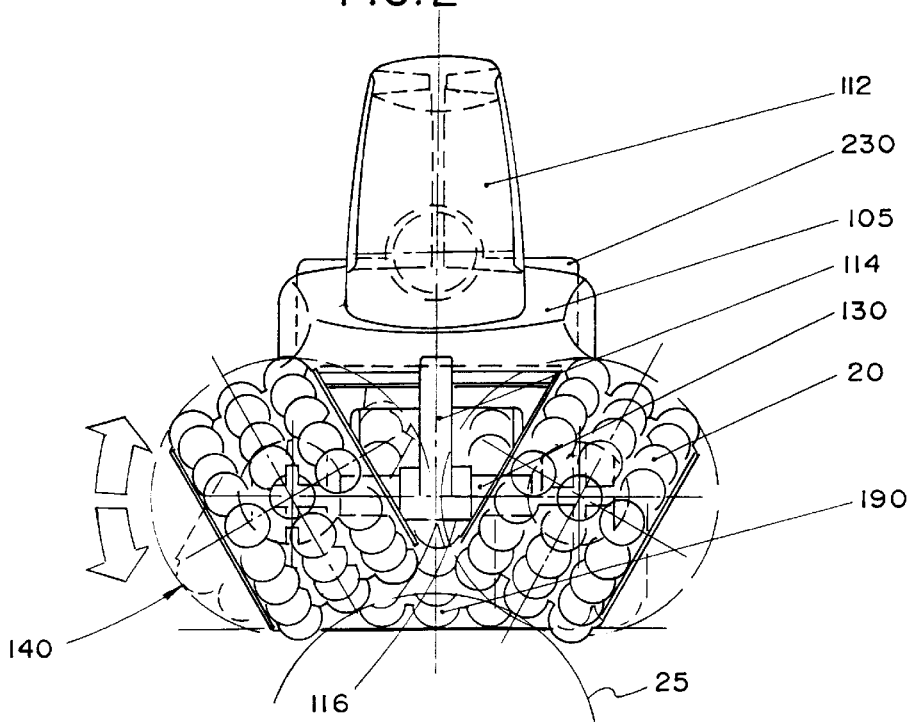
FIG. 3 is a front view of the massaging apparatus shown in FIG. 1, with the mechanical rollers in a slanted position.

Integral with the body 105 is a generally vertical bracket 114 which extends downwardly from the front end 110. As shown in FIG. 1, bracket 114 has a wide top that tapers as it extends downwardly and away from body 105. Bracket 114 terminates in an open clasp 116 that receives a front axle 130. Since clasp 116 is preferably made of rigid plastic, the front axle 130 pressure snaps into clasp 116. As shown in FIGS. 2 and 3, bracket 114 also has a narrow width so as not to interfere with the movement of front rollers 140. Likewise, the front end 110 of body 105 has a taper 118 curved about front roller 140 so as not to interfere with the movement of front rollers 140.

As best shown in FIGS. 2 and 3, clasp 116 is preferably wider than bracket 114 in order to provide greater horizontal stability to front axle 130. The widened clasp 116 further provides a stronger connection between the clasp 116 and front axle 130. A front massaging roller 140 is mounted at each end of front axle 130 in a manner to be described in further detail below.

As shown in FIG. 2, the rear end 170 of body 105 is forked, and the inside surface of each fork 172 has a hole 174 for receiving a rear axle 176. An annulus 178 protrudes outwardly from the inside surface of each fork 172 surrounding hole 174. Annulus 178 retains rear axle 176 in holes 174, and provides support for the rear axle 176. A single rear massaging roller 190, having a centrally located through-hole 192, is rotatably mounted onto rear axle 176. Rear massaging roller 190 is juxtaposed between forks 172 and is centrally mounted about the rear end 170 of body 105.

Rear massaging roller 190 is connected to body 105 by first passing rear axle 176 through the through-hole 192 of rear roller 190. The forks 172 of the massager 10 are then forced apart, and the rear axle 176 is positioned to align with holes 27. The forks 172 are then released, so that rear axle 176 and the mounted rear massaging roller 190 become fixedly secured to body 105. As so constructed, the rear massaging roller 190 may be removed and replaced by reversing the process. Once connected to body 105, rear massaging roller 190 freely rotates on rear axle 176.

As will become apparent, the two front massaging rollers 140 and the rear massaging roller 190 preferably have the same diameter, width and circumferential construction. Mounted on the outer circumference of each roller 140 and 190 is an annular massaging element 19 having a plurality of mechanical massaging protrusions 20, such as rounded knobs. Each annular massaging element 19 together with the surface massaging protrusions is preferably of one-piece construction, made from any suitable materials, such as known elastomeric and other rubber-like materials, which have some elastic capability to be slightly stretched and frictionally mounted on the rollers. Further, the elements 19 with protrusions 20 can be molded to provide any desired massager texture, soft or hard, coarse or fine.

Protrusions 20 are preferably arranged in concentric rows of three about the outside cylindrical surface of the rollers 140 and 190. Protrusions 20 are preferably in the form of truncated or semi-spherical studs; the protrusions 20, however, may be arranged in any desired fashion and have any desired shape, such as conical. In addition, the massaging elements 19 and protrusions 20 can be different on different rollers, as desired, e.g., rear roller 190 providing a different massaging feel from front rollers 140.

Turning back to FIG. 1, handle 112 is detachably fastened on the top of the front end 110 of body 105 by any suitable fastening means (not shown). Alternatively, handle 112 and body 105 can be molded together in a one-piece construction. A grip 113 is located along the side surfaces of handle 112. Preferably, grip 113 is a roughened portion of the handle 112. Alternatively, grip 113 may comprise a high friction material, such as a rubber, that is adhered to the side surface of the handle 112.

Hydraulic component or head 200 of the present invention essentially has two components, a longitudinal arm 210 and a spray chamber, preferably in the form of a transverse cylinder 230, preferably molded of one-piece construction. The arm 210 is a hollow cylindrical tube having one end 212 leading into the transverse cylinder 230. Cylinder 230 is perpendicular to, and wider than, arm 210 so that the hydraulic component 200 generally forms a T-shape. The opposite end 214 of arm 210 has an exterior or male thread (not shown). Domestic water is supplied to hydraulic head 200 by connecting a flexible hose 216 to the end 214 of hydraulic head 200. The hose 216 has a female threaded nut 218 that attaches to the threaded end 214 of the arm 210.

Figure 6:
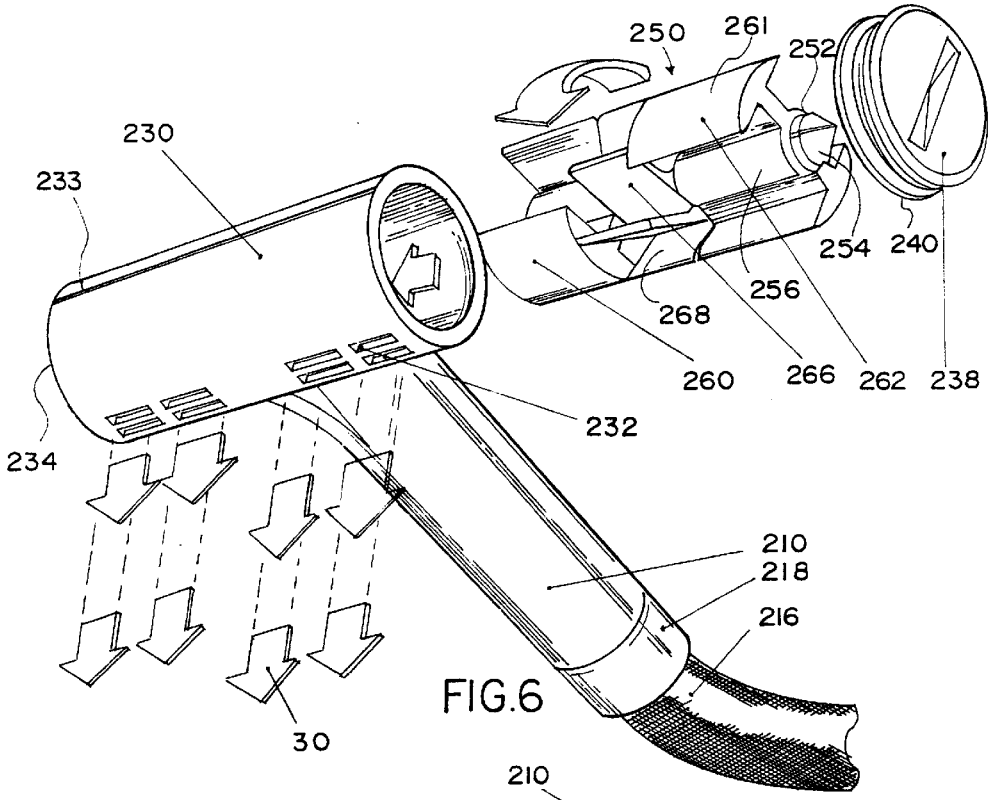
FIG. 6 is an exploded perspective of a preferred hydraulic component for the massaging device of the present invention, showing the arrangement of the turbine inside the spray chamber cylinder to provide pulsating hydraulic massaging action.

Once the hydraulic portion 200 has been connected to the hose 216, and the water supply turned on, water will then travel through longitudinal arm 210 to the cylinder 230. The water then exits cylinder 230 as high pressure jets 30 through openings or nozzles 232 located in the underside of cylinder 230. In the embodiment shown in FIGS. 1 and 2, nozzles 232 are elongated slots cut in the bottom of cylinder 230, so that jets 30 project outwardly from nozzles 232 in a conical spray pattern as shown in FIG. 1. In an alternative embodiment, nozzles 232 can be formed by a series of slots, such as four slots spaced on each side in cylinder 230, as shown in FIG. 6.

A cylindrical shaped receiving seat or nest 120 is transversely located in the middle section 149 of body 105, generally equally spaced between the front and rear massaging rollers 140 and 190. Hydraulic head 200 detachably mounts with body 105 by securing transverse cylinder 230 in nest 120. Cylinder 230 attaches to nest 120 so that the nozzles 232 are generally perpendicular to the body surface to be massaged, shown in FIG. 1 as surface 25.

An opening 128 is formed in the bottom of nest 120 of body 105 so that when the hydraulic component 200 is secured in the nest 120, there is no obstruction beneath nozzles 232. In this manner, the jets of water 30 pass directly onto the user's body 25. Preferably, nest 120 has the same length as cylinder 230 and is lined with a suitable liner 122. Liner 122 can be made from an elastomer, rubber or like material to provide a tight seal between the cylinder 230 and the nest 120.

Cylinder 230 is secured against falling out of the nest 120 by elongated tooth-shaped members 124 located on either side of nest 120. Members 124 extend substantially along the entire top edge of the nest 120, as shown in FIG. 2. As best shown in FIG. 6, cylinder 230 has corresponding grooves 233 which extend along the upper front and rear surfaces. As cylinder 230 is placed into nest 120, teeth 124 snap into the corresponding grooves 233 on the cylinder 230 and thus hold the hydraulic component 200 in a fixed operating position in body 105.

The top or crown 126 of the tooth-shaped members 124 project outwardly from the top end of nest 120. To release hydraulic head 200 from body 105, the crowns 126 of the tooth-shaped members 124 are pressed back. The hydraulic head 200 is thereby released, and may then be used as a separate hydraulic massaging device or a plain shower device. Likewise, the mechanical component 100 may also be used separately as a separate mechanical massaging device.

The front massaging rollers 140 and the rear massaging roller 190 are designed to rotate about front and rear axles 130 and 176, respectively, in order to permit massager 10 to move in a forward and rearward direction. In FIGS. 1 and 2, the forward direction is to the left and the rearward direction is to the right. The rollers 140 and 190 rotate in response to movement of massager 10 against the surface of a body 25.

In addition, as shown in FIG. 3, front massaging rollers 140 are mounted on the ends of front axle 130 by a universal connection, specifically ball joints 168. Hence, front massaging rollers 140 are capable of pivoting about front axle 130 in all directions, including transverse to the forward and rear directions. In the frontal perspective of FIG. 3, for instance, each front massaging roller 140 is shown independently pivoting clockwise and counter-clockwise about axle 130 on its respective ball joint 168. In the preferred embodiment, front rollers 140 are capable of pivoting transversely to approximately a maximum of about 30°–40° from the vertical.

Front massaging rollers 140 are thus able to pivot in response to the shape of the body 25 so that the massaging surface of the front rollers 140 can remain generally perpendicular to body surface 25. The wide range of motion of front rollers 140 allows the massager 10 to adapt to a wide range of curvatures of the user's or patient's body 25. For instance, the body surface 25 shown in FIG. 3 is more rounded than the body surface 25 of FIG. 1. The distance between the front rollers 140 is such that when fully slanted, rollers 140 almost touch each other, allowing for the massaging of such small body parts as, for instance, fingers and toes.

Figure 4:
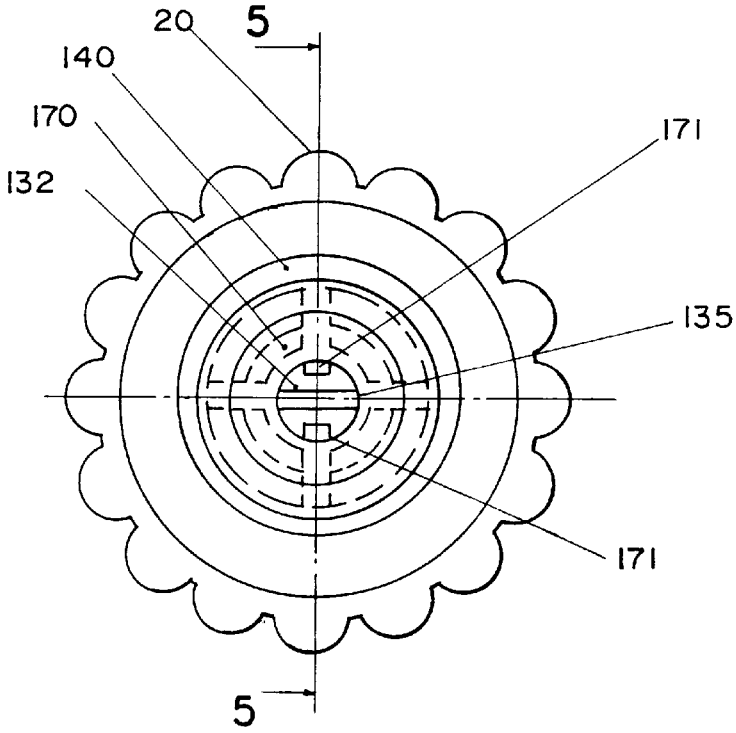
FIG. 4 is a side view of a front roller of the massaging apparatus of FIG. 1.

Now turning to FIGS. 4 and 5, the manner in which the front massaging rollers 140 are mounted to the front axle 130 for universal movement through ball joints 168 will be described in detail. First, rigidly mounted on each end of the axle 130 is a ball or spherical joint 170. A bore 172 passes through the center of the spherical joint 170. The bore 172 defines an opening at each end of the spherical joint 170. A circular depression 176 is formed in the spherical joint about the outside opening 174 of the bore 172. The circular depression 176 defines a ledge 178 about the opening 174.

Axle 130 has a reduced diameter end 132 which passes through bore 172 of the spherical joint 170. The axle end 132 also has a longitudinal slot 135 which separates resilient legs or tines 134. The distal ends of tines 134 have rounded protrusions 136. Protrusions 136 increase the size of axle end 132 so that tines 134 must be compressed in order to pass axle end 132 through bore 172. Once the protrusions 136 exit opening 174 on the opposite end of spherical joint 170, the tines 134 return to their normal position and the protrusions 136 come to rest against the ledge 178 of depression 176.

The diameter of the axle end 132 and the bore 172 of spherical joint 170 are configured such that when assembled, spherical joint 170 is held in place by the frictional engagement between the outer surface of axle end 132 and the inner surface of bore 172. The reduced diameter of axle end 132 forms a cylindrical abutment 137 where the diameter of axle 130 is reduced. When the axle end 132 is assembled in bore 172, the inner surface of the spherical joint 170 adjacent bore 172 also engages abutment 137, as shown in FIG. 5. Thus, the spherical joint 170 is interlocked on axle end 132 between abutment 137 and protrusions 136.

Further, protrusions 136 are located in depression 176. Hence, the end of front axle 130 will be recessed below the outer surface of spherical joint 170. In addition, protrusions 136 have notches 171 (see FIG. 4) in their periphery to assist in grasping the protrusions 136 in order to force resilient tines 134 towards each other when removing axle end 132 from through bore 172 and engagement with the spherical joint 170 (and its related front roller 140).

Front roller 140 is rotatably mounted on spherical joint 170. The front rollers 140 have an annular support member 142, an annular inner or front bearing shell 180 and an annular outer or bottom bearing shell 182. Annular support member 142 has an annular outer tier 144 and an annular inner tier 146, interconnected by a centrally located annular brace 148 to form the shape of an "H" in cross-section, as shown in FIG. 5. Outwardly turned cylindrical lips 150 are located at either end of the outer tier 144 of the support member 142. When the annular massaging components 19 are positioned on the outer surface of outer tier 144, they are held laterally in place between the outwardly turned lips 150. An inwardly turned cylindrical lip 152 is located on the outer or bottom end of inner tier 146.

The outer or bottom bearing shell 182 has a cylindrical notch 184 located on its bottom outer edge which comes to rest against the inside surface of inner tier 146 so that notch 184 mates with inwardly turned lip 152. The outer half of spherical joint 170 rests on the curved interior surface of the outer bearing shell 182. The inner bearing shell 180 is positioned against the inner half of the spherical joint 170.

The outer and inner bearing shells 182 and 180 each have an inwardly facing surface that is curved to conform with the shape of the spherical joint 170. The shells 180 and 182 thus cradle spherical joint 170 so as to fix spherical joint 170 within roller 140. The roller 140 is thus free to rotate in a universal manner in all directions on the joint 170. However, when the edge of inner bearing shell 180 engages axle 130, the wheel 140 is prevented from tilting further. The maximum tilt before stop contact is preferably about 30°–40° from the vertical.

Figure 5:
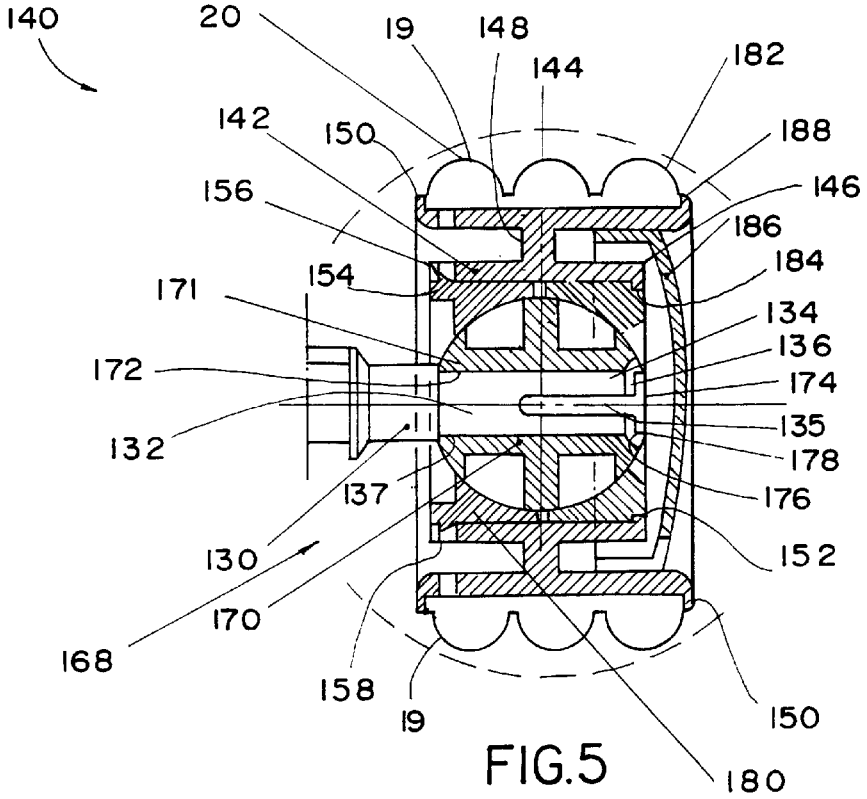
FIG. 5 is a cross-section taken along the line A—A of FIG. 4.

The inner bearing shell 180 has an outwardly projecting boss 154 having a tooth-shaped member 156 that mates with holes 158 located in the inner tier 146 as shown in cross-section in FIG. 5. The inner bearing shell 180, also preferably made of a plastic, permits boss 154 to bend during assembly to allow tooth-shaped member 156 to snap into hole 158 when the front bearing shell 180 is fully inserted into the inner tier 146 of the support member 142. Preferably, two teeth 156 are provided at 180 degrees from each other. Teeth 156 lock the inner bearing shell 180 into position, thereby preventing the support member 142 and related components of roller 140 from becoming dislodged from spherical joint 170 and thus axle end 132.

A cap 186 is preferably fitted over the outer end of each front roller 140. Cap 186 has a cylindrical outer lip 188 which friction fits against the inside surface of outer tier 144. Cap 186 thus prevents dirt, water, and other contaminants from entering the roller 140 and interfering with the operation of the ball joint 168. Cap 186 further prevents hair, fingers, or other small objects from becoming entangled during operation with roller 140 to prevent injury.

The sequence for assembly of the front massaging wheels 140 and the axle 130 will now be briefly described. The outer or bottom bearing shell 182 is inserted into support member 142 such that it comes to rest against the inside surface of inner tier 146 with notch 184 mating with inwardly turned lip 152. The spherical joint 170 is placed within the support member 142 so that it rests on the curved interior surface of the outer bearing shell 182 with the bore 172 generally facing outwardly. The inner bearing shell 180 is then positioned in the inner tier 146 against the inner half of the spherical joint 170 such that tooth-shaped member 156 snaps into holes 158 to lock the various elements of front massaging roller 140 together in assembled position. The annular massaging component 19 can be assembled on the outer tier 144 of the support member 142 at any time during assembly of the front massaging wheel 140, or even after it has been mounted on the axle end 132.

The front wheel assembly is next mounted on the axle end 132 by squeezing together tines 134 and inserting axle end 132 into bore 172. Once the distal end of end 132 progresses through bore 172, the protrusions 136 exit opening 174 and come to rest against the ledge 178 of depression 176, thus preventing the spherical joint 170 coming off the end of axle end 132. At the same time, the innermost edge of joint 170 adjacent bore 172 engages abutment 137, thus preventing spherical joint 170 from moving inwardly. As so mounted, spherical joint 170 is rigidly locked onto the end of axle 130.

Now turning to FIG. 6, a preferred embodiment of the transverse cylinder 230 is shown. Two sets of four nozzles 232 preferably extend along the bottom of the cylinder 230. The two sets of nozzles 232 are preferably located at either end of cylinder 230, and no nozzles are located in the middle of cylinder 230. Each nozzle 232 is cut in cylinder 230 to form a strong water jet 30. The breadth of the jets 30 is designed to correspond generally with the span of the front rollers 140 in normal use.

Cylinder 230 has a closed end 234 and an open end 234. The open end 234 has an interior thread that mates with the male thread of a removable screw cap 238. A cylindrical seal 240 is positioned along the circumference of cap 238 to provide a water- tight fit between cap 238 and open end 234 of cylinder 230. The closed end 234 and inside surface of cap 238 each have a central indentation 242 in the shape of an inverted cone, or the like. It is also contemplated that closed end 234 could also be open and fitted with threads, a removable screw cap 238 and seal 240 in the same manner as open end 234.

A cylindrically shaped turbine 250 is placed inside cylinder 230. Turbine 250 is a single component having integrated elements including a shaft 252, ends 254, blades 260 and 261 and rotor 266. In the preferred embodiment, turbine 250 is constructed of one-piece molded plastic including blades 260 and 261 and rotor 266 fixedly mounted about shaft 252. Preferably, turbine 250 is molded from the same plastic material as cylinder 230 and arm 210. Although not preferred, blades 260 and 261 and rotor 266 can be detachable from shaft 252 so that they may be replaced, if desired.

Shaft 252 has two conical-shaped ends 254. When turbine 250 is placed inside cylinder 230 and covered with cap 238, ends 254 couple with respective indentations 242 located in the closed end 234 and cap 238, respectively. The ends 254 and indentations 242 maintain turbine 250 in an aligned longitudinal position within cylinder 230 so that the turbine 250 may turn freely about ends 254 without hitting the sides of cylinder 230.

The blades 260 and 261 are set at right angles to each other at each end of turbine 250. The blades 260 and 261 each have a top section 262 supported by a narrow, elongated upright support structure 264 for attachment to the shaft 252. The shaft 252 is also enlarged as at 256 where the support structure 264 is mounted on the shaft. The top 262 of the blades 260 and 261 is preferably curved to conform with the shape of the inner surface of the cylinder 230. In accordance with the preferred embodiment of the invention, blades 260 and 261 are located at each end of turbine 250 and consist of two opposing tops 262 and respective upright portions 264.

Figure 7:
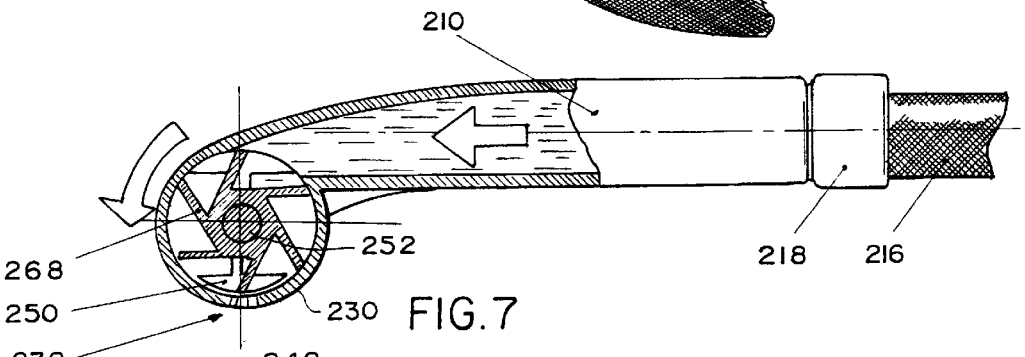
FIG. 7 is a side view, partly sectioned, of the hydraulic component shown in FIG. 6.
Figure 8:
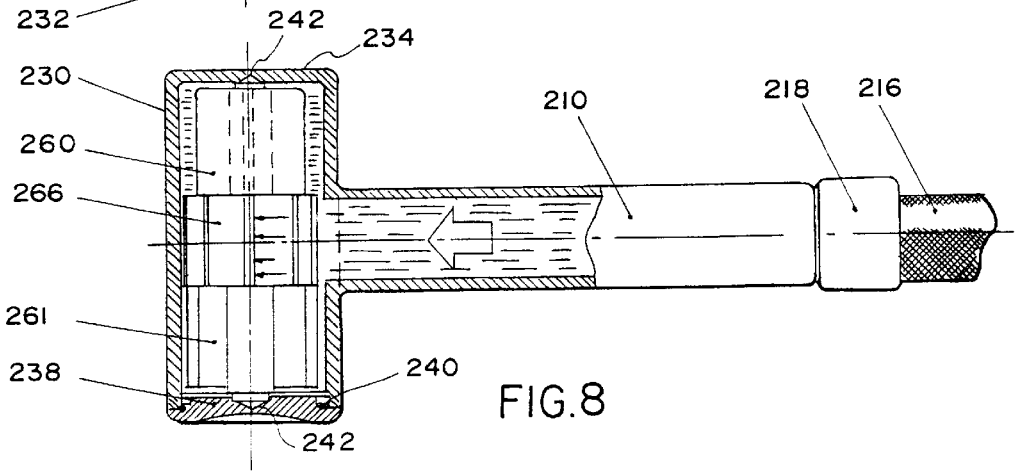
FIG. 8 is a partly sectioned plan top view of the hydraulic component shown in FIG. 6.

A rotor 266 is located generally in the middle of turbine 250, abutted on each side against blades 260 and 261. The rotor 266 comprises a plurality of elongated paddles 268 that extend outwardly. In the preferred embodiment of the invention, six paddles 268 are equally spaced about shaft 254. As best shown in FIG. 7, paddles 268 are set at about 60 to 65 degree angles to each other.

As shown in FIGS. 7–11, water passes from hose 216, along arm 210 into cylinder 230. The rushing water drives rotor 266, which in turn propels turbine 250. The nozzles 232 on each end of cylinder 230 are aligned beneath blades 260 and 261, and are not aligned with rotor 266. Thus, rotor 266 is confined within a closed lower wall of cylinder 230 in order to impart a greater driving force to rotor 266. As turbine 250 rotates, the blades 260 and 261 intermittently block respective nozzles 232. As blades 260 and 261 obstruct the nozzles 232, water is prevented from escaping, thereby creating a pulsating effect for water jets 30. In addition, blade 260 is offset by 90 degrees to blade 261 so that a further pulsating effect is created between the respective nozzles 232.

Figure 9:
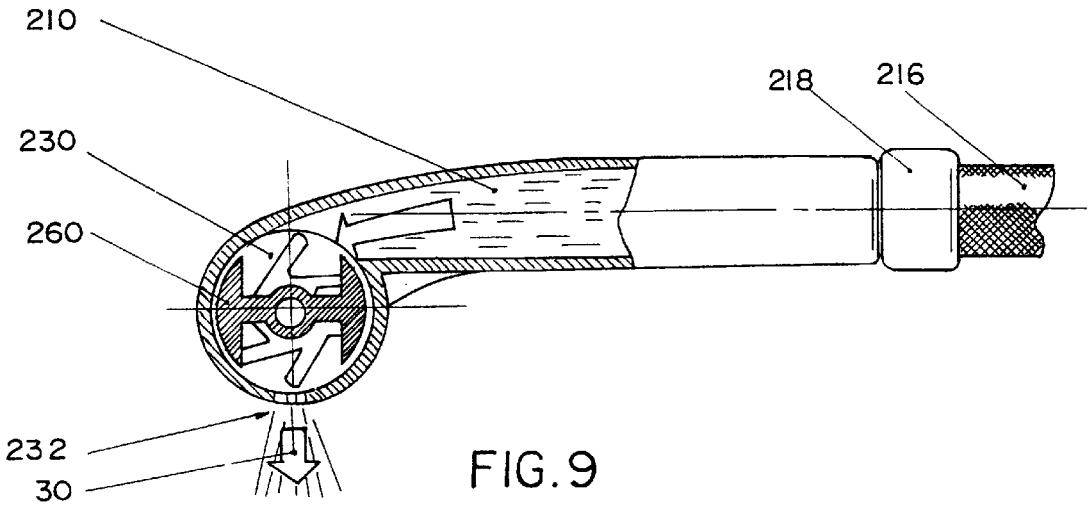
FIG. 9 is a partly sectioned side view showing the hydraulic component shown in FIG. 6, with the rotor for providing the pulsing water jets in an open position.
Figure 10:
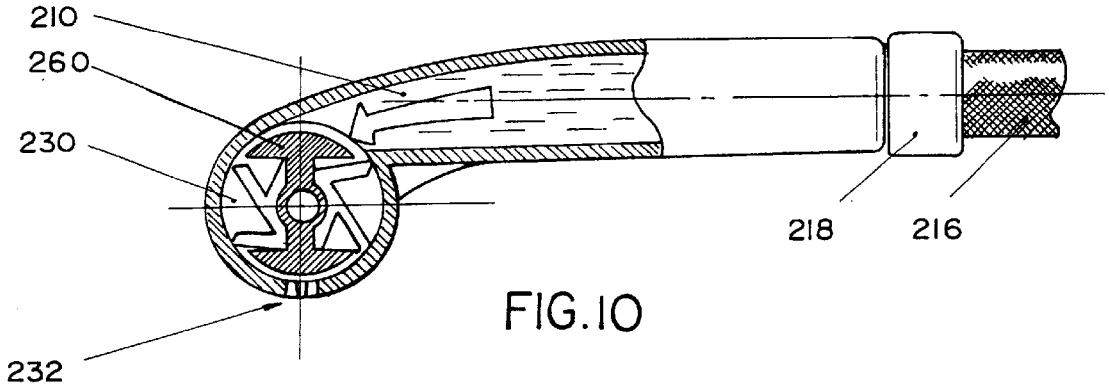
FIG. 10 is a partly sectioned side view, as in FIG. 9, showing the hydraulic component with the rotor in a closed position.

FIG. 9 shows the blade 260 in the open position so that water is emitted from nozzles 232, creating water jets 30. FIG. 10 shows blade 260 aligned with nozzles 232 in a closed position. In the closed position, water is prevented from exiting nozzles 232, and no jet 30 is permitted. Accordingly, a water pulsating effect is achieved as the water jets 30 are being periodically interrupted by the rotation of blades 260 and 261.

Figure 11:
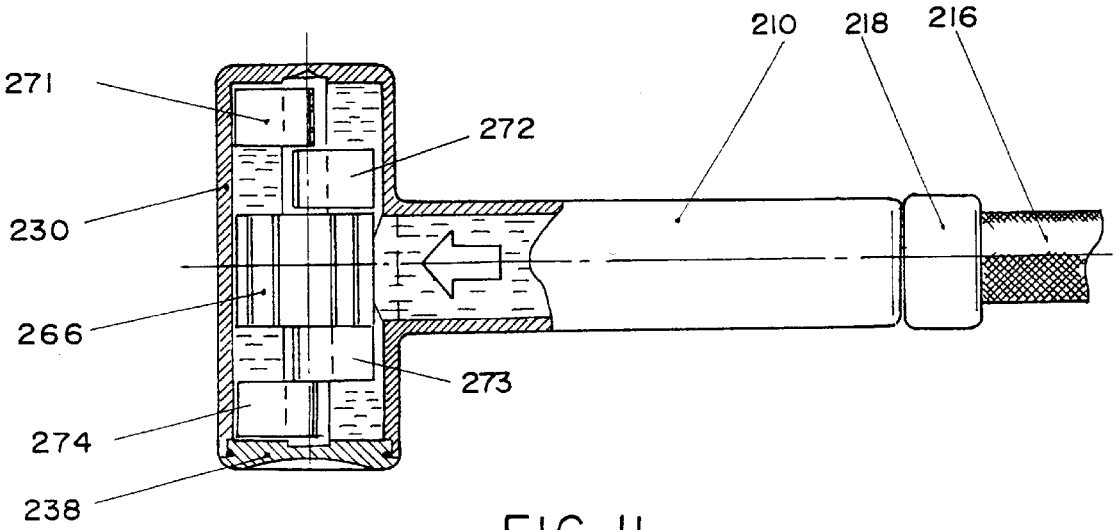
FIG. 11 is a top view of a most preferred embodiment of the turbine for the hydraulic component of the present invention, with the turbine having alternating blades to provide more rapid pulsating jet spray.

Now turning to FIG. 11, a most preferred embodiment of the turbine 250 is shown positioned in cylindrical spray chamber 230. This turbine is provided with multiple narrow blades 271, 272, 273 and 274. Each of the blades 271, 272, 273 and 274 is positioned to align with a circumferential pair of the nozzles 232 as shown in FIG. 6. Blades 271 and 274 are offset from blades 272 and 273 to provide a varied pulsating effect. The number of blades 271–274 provided on turbine 250 can be up to the number of sets of nozzles 232 provided on cylinder 230. Also, by changing the arrangement of blades 271–274, different water pulsating patterns can be provided.

As described, the various components of the hydromechanical massager of the present invention are molded from rigid plastic materials, preferably acrylonitrile butadiene styrene (ABS) or polyester. Other suitable plastic materials can also be used such as polyethylene, polypropylene, or the like. The molded plastic components include body 105 and handle 112, front axle 130 and components of the front wheels 140 and ball joints 168, rear axle 176 and rear roller 170, and all of the elements of the hydraulic component 200 including the cylindrical spray chamber 230, arm 210 and turbine 250. Preferably, all of these plastic components are molded from the same plastic material, although different compatible plastic materials may be utilized. Also, while plastic is preferred, the components of the present invention may be made from other rigid materials, such as appropriate metals and the like. Finally, annular massaging elements 19 with protrusions 20 are molded in one piece from suitable elastomeric, rubber or like materials.

The hydromechanical massaging apparatus 10 may be used as a professional massaging device as well as a domestic appliance connected to a hose 216 of an existing shower unit (not shown). As a professional device, it could be used in hospitals for post-operative therapy, in resorts and recreational centers, sport centers and the like. When used as a professional device, the massaging apparatus 10 is preferably connected to a source of warm and cold water under a predetermined pressure, with regulated water flow and preset water temperature.

The foregoing descriptions and drawings should be considered as illustrative only of the principles of the invention. Numerous applications of the present invention will readily occur to those skilled in the art. For example, the hydraulic component 200 may be rigidly secured to body 105 and arm 210 can function as the handle to control movement of massager 10, thus eliminating the need for separate handle 112. However, to reduce the possibility of damage, the preferred embodiment includes a separate handle. Therefore, it is not desired to limit the invention to the specific examples disclosed or the exact construction and operation shown and described. Rather, all suitable modifications and equivalents may be resorted to, falling within the scope of the invention.

What is claimed is:

1. A hydromechanical massaging device comprising:

a body having a front end and a rear end defining a longitudinal axis for said body, the front end having a bracket for receiving a front axle substantially perpendicular to said longitudinal axis;

at least one front massaging roller connected to the front axle and having an irregular circumferential surface for mechanical massaging;

a rear massaging roller connected to the rear end of said body which rotates about a transverse axis substantially perpendicular to said longitudinal axis and having an irregular circumferential surface for mechanical massaging;

a handle extending from said body;

a receiving structure located in said body between said front end and said rear end; and a hydraulic component having a spray chamber for emitting massaging water jets removably received in said receiving structure and directing said jets outwardly between said front and rear rollers.

2. The massaging device of claim 1, wherein the spray chamber is cylindrical with at least one open end, and a cap for removably closing said open end.

3. The massaging device of claim 2, wherein said cylindrical spray chamber houses a turbine having blades and a rotor, the rotor driving the turbine so that the blades intermittently obstruct passage of water through the nozzle to provide a pulsating jet.

4. The massaging device of claim 3, wherein the turbine further comprises a center rod having conical-shaped ends that rotatably engage with indentations in each of the ends of said cylindrical chamber.

5. The massaging device of claim 1, wherein teeth are located at the entrance to said receiving structure for removably engaging with a respective groove located on the spray chamber.

6. The massaging device of claim 1, wherein each of the at least one front roller is connected to the front axle by a spherical joint, each front roller capable of being pivoted in all directions about the front axle.

7. The massaging device of claim 1, wherein the at least one front roller is connected to the body by a front axle fitted with a spherical joint, the at least one front roller comprising a brace having an outer tier for supporting massaging members and an inner tier for receiving a bottom bearing shell and a front bearing shell, wherein the bottom and front bearing shells have a curved interior surface for pivotally receiving the spherical joint.

8. The massaging device of claim 7, wherein the inner tier has a first end having an inwardly turned lip for engaging a notch located in the bottom bearing shell and further has a second end opposite the first end having a hole for receiving a tooth member located in the front bearing shell, wherein the hole and tooth member cooperate to interlock the spherical joint with said front roller.

9. The massaging device of claim 8, wherein the front axle has a slotted end having tines and an annular protrusion at the far end of the tines and the spherical device has a circular through-hole and a depression defining a ledge at the far end of the through-hole, wherein the protrusions engage with the ledge to interlock the axle with the spherical joint.

10. A hydromechanical massaging device comprising a hydraulic component having an elongated arm and a spray chamber, said elongated arm forming a handle with a connector at one end connected to a water supply and an opposite end of the handle connected to said spray chamber, said chamber having a nozzle for emitting a water jet; and a mechanical component having a body with a front end, a middle section and a rear end defining a longitudinal axis for said body, said front end connected to at least one front massaging roller about a front axle substantially perpendicular to the longitudinal axis, said rear end connected to a rear massaging roller about a rear axle substantially perpendicular to the longitudinal axis, said front massaging roller connected to said front end for limited universal motion; said spray chamber positioned at said middle section so that the water jet emits outwardly between said front and rear massaging rollers.

11. The massaging device of claim 10, wherein the spray chamber further comprises at least one open end, and a cap for removably closing said open end.

12. The massaging device of claim 11, wherein said spray chamber receives a turbine having at least one blade and a rotor, the rotor driving the turbine so that said blade intermittently obstructs passage of water through the nozzle to provide a pulsating jet.

13. The massaging device of claim 12, wherein the turbine further comprises a center rod having conical-shaped ends that are rotatably supported in said spray chamber.

14. The massaging device of claim 10, wherein teeth are located at the entrance to said receiving structure for removably engaging with a respective groove located on the spray chamber.

15. The massaging device of claim 10, wherein two front rollers are connected to the front axle, each front roller capable of being pivoted in all directions about the front axle.

16. The massaging device of claim 10, wherein the at least one front roller is connected to the body by a front axle fitted with a spherical joint, the at least one front roller comprising a brace having an outer tier for supporting massaging members and an inner tier for receiving a bottom bearing shell and a front bearing shell, wherein the bottom and front bearing shells have a curved interior surface for pivotally receiving the spherical joint.

17. The massaging device of claim 16, wherein the inner tier has a first end having an inwardly turned lip for engaging a notch located in the bottom bearing shell and further has a second end opposite the first end having a hole for receiving a tooth member located in the front bearing shell, wherein the hole and tooth member cooperate to interlock the spherical joint with said front roller.

18. The massaging device of claim 17, wherein the front axle has a slotted end having tines and an annular protrusion at the far end of the tines and the spherical device has a circular through-hole and a depression defining a ledge at the far end of the through-hole, wherein the protrusions engage with the ledge to interlock the axle with the spherical joint.

19. A hydromechanical massaging device which comprises a body supporting at least one movable mechanical massaging element and a hydraulic component having a connection for water supply and a spray means which emits pulsating water jets adjacent said mechanical massaging element.

20. The massaging device of claim 19, wherein said body has a front end and a rear end and said movable mechanical massaging element is at least one massaging roller supported adjacent said front end and at least one massaging roller supported adjacent said rear end, and said spray means emits said pulsating water jets between said rollers.

21. The massaging device of claim 20, wherein said massaging rollers have removable resilient protrusion treads mounted thereon.

22. The massaging device of claim 19, wherein said spray means includes a generally cylindrical spray chamber having openings in an outer wall to form water emitting nozzles, a turbine received within said spray chamber and having blades and a rotor, said rotor driving the turbine under the influence of water entering said spray chamber so that the blades intermittently obstruct passage of water through said nozzles to thus provide said pulsating water jets.

23. The massaging device of claim 19, wherein said spray means is removable from said body for hydraulic massage separate and apart from said mechanical massaging element.

24. A hydromechanical massaging device comprising a body with a longitudinal axis, the body having at least one axle extending generally transversely of said body substantially perpendicular to said longitudinal axis, and supporting at least one massaging roller having an irregular circumferential surface for mechanical massaging when rolled over a massage surface, said roller connected to said axle by a spherical joint providing substantial universal movement of said roller about said axle, and a hydraulic component having a connection for water supply and a spray means for emitting water jets adjacent said massaging roller.

25. The massaging device of claim 24, wherein said at least one axle is a front axle and said body has a rear axle extending generally transversely of said body and supporting a second massaging roller having an irregular circumferential surface for mechanical massaging when rolled over a massage surface, and said water jets emitted between said front and rear axles.

26. The massaging device of claim 25, wherein said front axle supports two massaging rollers spaced from each other, each having an irregular circumferential surface for mechanical massaging when rolled over a massage surface and connected to the front axle by a spherical joint providing substantial universal movement of said rollers about the front axle.

27. The massaging device of claim 24, wherein said at least one axle is fitted with said spherical joint and the at least one roller comprises a brace having an outer tier for supporting replaceable massaging members and an inner tier for receiving a bottom bearing shell and a front bearing shell, said bottom and front bearing shells having a curved interior surface for pivotally receiving the spherical joint for substantial universal movement of said roller on said axle.

28. The massaging device of claim 27 wherein the inner tier has a first end having an inwardly turned lip for engaging a notch located in the bottom bearing shell and further has a second end opposite the first end having a hole for receiving a tooth member located in the front bearing shell, wherein the hole and tooth member cooperate to interlock the spherical joint with said front roller.

29. The massaging device of claim 28, wherein the axle has a slotted end having tines and an annular protrusion at the far end of the tines and the spherical device has a circular through-hole and a depression defining a ledge at the far end of the through-hole, wherein the protrusions engage with the ledge to interlock the axle with the spherical joint.

30. The massaging device of claim 24, wherein said water jets are emitted from said spray means in a pulsating stream.

31. A hydromechanical massaging device comprising an elongated body having a longitudinal axis, a front axle and a rear axle mounted on said body and extending generally transversely of said body substantially perpendicular to said longitudinal axis, each of said axles supporting at least one massaging roller for rolling movement when rolled over a massage surface, resilient annular massaging elements mounted on each of said rollers and having mechanical protrusion treads thereon for engaging and massaging a massage surface in a direction generally parallel to said longitudinal axis when said rollers are rolled over said surface, and a hydraulic component having a connection for water supply and a spray means for emitting water jets between said massaging rollers, said hydraulic component removably mounted within said body.

32. The massaging device of claim 31, wherein said annular massaging elements are removable from said rollers for replacement with another annular massaging element having the same or different pattern of protrusion treads.

33. The massaging device of claim 31, wherein said annular massaging elements are made of an elastomeric material.

34. The massaging device of claim 31, wherein said front axle supports two massaging rollers, each massaging roller mounted on said front axle for substantial universal movement about the front axle.

35. A hydromechanical massaging device which comprises a body having a quick connection mounted within said body, at least one axle extending generally transversely of said body and supporting at least one massaging roller having an irregular circumferential surface for mechanical messaging when rolled over a massage surface, and a hydraulic component having a connection for a flexible water supply line, and a spray means for emitting water jets adjacent said massaging roller, said spray means including a generally cylindrical spray chamber which is removably connected to said body by said quick connection for quick connect and quick disconnect from said body so that said hydraulic component is removable from said body for hydraulic massage separate and apart from said mechanical massaging roller.

36. The massaging device of claim 35, wherein said at least one movable mechanical massaging elements includes at least one front massaging roller and at least one substantially identical rear massaging roller, and said generally cylindrical spray chamber when said hydraulic component is connected to said body being positioned generally intermediate said front and rear massaging rollers.

37. The massaging device of claim 35, wherein said spray means emits pulsating water jets.

* * * * *